US009902043B2

(12) United States Patent
Jung

(10) Patent No.: US 9,902,043 B2
(45) Date of Patent: Feb. 27, 2018

(54) CUTTING TOOL

(71) Applicant: RHODIUS SCHLEIFWERKZEUGE GMBH & CO. KG, Burgbrohl (DE)

(72) Inventor: Michael Jung, Doernberg (DE)

(73) Assignee: RHODIUS SCHLEIFWERKZEUGE GMBH & CO. KG, Burgbrohl (DE)

( * ) Notice: Subject to any disclaimer, the term of this patent is extended or adjusted under 35 U.S.C. 154(b) by 148 days.

(21) Appl. No.: 14/917,952

(22) PCT Filed: Sep. 9, 2014

(86) PCT No.: PCT/EP2014/069127
§ 371 (c)(1),
(2) Date: Mar. 10, 2016

(87) PCT Pub. No.: WO2015/036377
PCT Pub. Date: Mar. 19, 2015

(65) Prior Publication Data

US 2016/0221154 A1 Aug. 4, 2016

(30) Foreign Application Priority Data

Sep. 12, 2013 (DE) ..... 10 2013 110 009

(51) Int. Cl.
*B24D 5/12* (2006.01)

(52) U.S. Cl.
CPC ..... *B24D 5/123* (2013.01)

(58) Field of Classification Search
CPC . B24D 5/123; B24D 5/06; B24D 5/08; B24D 5/16; B28D 1/121
USPC ..... 451/541
See application file for complete search history.

(56) References Cited

U.S. PATENT DOCUMENTS 2,475,892 A * 7/1949 Hasty ..... B23D 61/06 125/15
2,479,079 A * 8/1949 Reid, Jr. ..... B24D 5/04 451/542
2,807,256 A * 9/1957 Woolley ..... B23D 59/025 125/13.01
3,261,383 A * 7/1966 Coblentz ..... B23D 45/102 125/13.01

(Continued)

FOREIGN PATENT DOCUMENTS

DE 20 2012 002 545 U1 7/2012
EP 2 193 882 A2 6/2010

*Primary Examiner* — George Nguyen
(74) *Attorney, Agent, or Firm* — Norman B. Thot

(57) ABSTRACT

A cutting tool includes a plurality of cut-off wheels which are arranged alongside one another coaxially along a common rotation axis. Each of the plurality of cut off wheels comprises a blade body which comprises a plurality of cutting segments distributed around a circumference of the blade body, each blade body defining a central cutting plane. Some of the plurality of cutting segments are configured to protrude axially out of the central cutting plane. The plurality of cutting segments are arranged so that a segment gap exists between two cutting segments arranged adjacent to one another in a direction of rotation. At least a first of the plurality of cutting segments arranged in a first axial position is configured to be larger than a second of the plurality of cutting segments arranged in a second axial position which differs from the first axial position.

5 Claims, 2 Drawing Sheets

(56) References Cited

U.S. PATENT DOCUMENTS

| | | | | |
|---|---|---|---|---|
| 5,020,280 | A * | 6/1991 | O'Reilly | B24B 23/02 125/13.01 |
| 5,184,597 | A * | 2/1993 | Chiuminatta | B24D 5/123 125/15 |
| 5,313,742 | A * | 5/1994 | Corcoran, Jr. | B24D 5/12 125/15 |
| 5,392,758 | A * | 2/1995 | Rognon | B23D 47/005 125/13.01 |
| 6,250,295 | B1 * | 6/2001 | Chanton | B24D 5/123 116/208 |
| 6,769,423 | B1 * | 8/2004 | Zhang | B28D 1/048 125/13.01 |
| 6,890,250 | B1 * | 5/2005 | Kim | B24D 5/00 451/541 |
| 7,073,496 | B2 * | 7/2006 | Corcoran | B24D 5/14 125/15 |
| 2002/0123302 | A1 * | 9/2002 | Maras | B23D 61/025 451/542 |

* cited by examiner

CUTTING TOOL

CROSS REFERENCE TO PRIOR APPLICATIONS

This application is a U.S. National Phase application under 35 U.S.C. § 371 of International Application No. PCT/EP2014/069127, filed on Sep. 9, 2014 and which claims benefit to German Patent Application No. 10 2013 110 009.0, filed on Sep. 12, 2013. The International Application was published in German on Mar. 19, 2015 as WO 2015/036377 A1 under PCT Article 21(2).

FIELD

The present invention relates to a cutting tool having a plurality of segmented cut-off wheels.

BACKGROUND

In the production of wall slots, for example, for laying electrical lines, it is common practice to use a cutting disk to initially make two parallel cuts in the wall. However, a central strip initially remains between the cuts which must subsequently be laboriously removed with a chisel.

EP 2 193 882 B1 describes cut-off wheels for creating wide notches of more than 5 mm in walls. The circumference of a blade body is provided with a plurality of cutting segments. A segment gap remains between in each of the two cutting segments, respectively. In order to create a widened cut, the cutting segments are arranged in an offset manner with respect to a central cutting plane. Fairly wide cuts with respect to the actual wall thickness of the cut-off wheel can be made with such cut-off wheels. A smaller central strip remains if these cut-off wheels are used for making cuts in the wall which is easier to remove. Although the cutting width of such cut-off wheels could be increased further by widening the cutting segments, limits are imposed on such a widening since the risk of the cutting edge becoming clogged with removed material increases with the width of the cutting edges.

DE 20 2012 002 545 U1 describes a cutting tool which comprises three segmented cut-off wheels that each have a blade body and have cutting segments distributed around the circumference of the blade body. The cut-off wheels are arranged coaxially alongside one another in a non-releasable manner. Identical cut-off wheels are always used in such a cutting tool. It has been shown, however, that the cut-off wheels of such a cutting tool wear differently. The entire cutting tool can no longer be used if one of the cut-off wheels is worn. This is all the more regrettable since the remaining cut-off wheels that are not yet worn still remain functional per se but are nevertheless useless. A degree of raw materials wastage is therefore associated with this problem, the raw materials being fairly expensive, in particular in the case of diamond cut-off wheels.

SUMMARY

An aspect of the present invention is to provide an improved cutting tool which overcomes the above-mentioned disadvantages.

In an embodiment, the present invention provides a cutting tool which includes a plurality of cut-off wheels which are arranged alongside one another coaxially along a common rotation axis. Each of the plurality of cut off wheels comprises a blade body which comprises a plurality of cutting segments distributed around a circumference of the blade body, each blade body defining a central cutting plane. Some of the plurality of cutting segments are configured to protrude axially out of the central cutting plane. The plurality of cutting segments are arranged so that a segment gap exists between two cutting segments arranged adjacent to one another in a direction of rotation. At least a first of the plurality of cutting segments arranged in a first axial position is configured to be larger than a second of the plurality of cutting segments arranged in a second axial position which differs from the first axial position.

BRIEF DESCRIPTION OF THE DRAWINGS

The present invention is described in greater detail below on the basis of embodiments and of the drawings in which.

DETAILED DESCRIPTION

Figure 3:
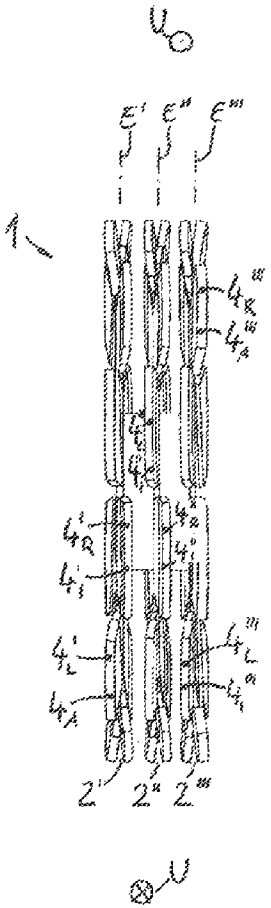
FIG. 3 shows a cutting tool according to the present invention in a perspective illustration.

The cutting tool according to the present invention comprises a plurality of cut-off wheels, in particular diamond cut-off wheels. The cut-off wheels are arranged alongside one another coaxially along a common rotation axis. Each cut-off wheel comprises a blade body having a plurality of cutting segments distributed around the circumference of the blade body, wherein each blade body defines a central cutting plane. In this respect, the cut-off wheels are segmented cut-off wheels. At least some of the cutting segments protrude axially out of the central cutting plane. A segment gap remains in each case between two cutting segments of a cut-off wheel that are adjacent to one another in the direction of rotation. The cutting segments are applied radially on the outside of a carrier region, which is in particular made of sheet metal. At least one of the cutting segments, which is arranged in a first axial position, is configured in an enlarged manner compared with a second cutting segment, which is arranged in a second axial position. The cutting segment is in particular understood to be that region of the cut-off wheel that is fastened radially on the outside of a carrier region and which comprises an abrasive material.

The present invention is in particular based on the finding that, although cutting segments wear at different rates, the cutting segments wear in a substantially uniform manner in identical axial positions. The present invention therefore selectively reinforces the cutting segments individually so that, as a result of enlargement, the reinforcement only concerns those few cutting segments which have an increased high level of wear. Increasing the service life of the cutting tool via a wholesale reinforcement thereof is therefore deliberately avoided. The individual segments have instead been selectively configured in an enlarged manner compared with other segments in order to match the service lives of all the segments to one another. Segments that are subjected to particularly high loads can be additionally reinforced; segments that are subjected to particularly low loads can also have their strength reduced, this having a direct impact on the outlay of raw material to be used. It is possible to determine via tests the extent to which an enlarged configuration of individual segments needs to occur so that the cutting segments are worn as uniformly as possible or have a service life that is as identical as possible in all positions. The intent of the present invention is therefore for segments to have a largely identical service life despite their different respective loads.

In an embodiment of the present invention, the at least one first cutting segment and the at least one second cutting segment can, for example, be arranged at axially opposite outermost axial positions of the cutting tool. In other words, this means: the axially outermost cutting segments on one outermost axial side are configured in a reinforced manner compared with the axially outermost cutting segments on the other outermost axial side. The reason therefor is not at first clear since the load appears to be identical at both axial outer positions of the cutting tool. This is, however, not usually the case. On account of the asymmetrical handling of the cutting tool and the machine tool used, it is possible to determine that one outermost axial position can be loaded to a much greater extent than the other outermost axial position. This can be as a result of handedness, for example, right-handed individuals basically subject the machine to a greater load on the right-hand side than on the left-hand side. Provision can therefore also be made for the cutting tools to be designed explicitly for left-handed people and explicitly for right-handed people, wherein different cutting segments need to be reinforced for each case.

In an embodiment of the present invention, one of the axially outer cut-off wheels can, for example, be equipped with a greater thickness (i.e., the cross-sectional thickness) than the other of the axially outer cut-off wheels. Although this produces an overall asymmetry in the cutting tool, the asymmetry again compensates for nonsymmetrical operation by an operator. Since most operators are right-handed, the right-hand cut-off wheel wears, for example, to a greater extent than the left-hand outer cut-off wheel. The reverse correspondingly applies for left-handed people as explained above. In order to increase the thickness of the cut-off wheel, it is already sufficient to merely increase the cross-sectional thickness of the segments.

In an embodiment of the present invention, the outer cut-off wheels can, for example, have a greater thickness than the internal cut-off wheels. The fact that the outer segments are usually loaded to a greater extent than the internal segments should here basically be taken into account. The outer segments introduce the external cut into the solid masonry. The internal segments are provided to remove the remaining central strip between the external cuts. In contrast to the solid masonry, only a small work input is required to remove the central strip since the stability of the central strip has already been reduced by the missing lateral support. It is thereby sufficient merely for the cross-sectional thickness of the segments of the outer cut-off wheels to be increased.

In an embodiment of the present invention, a segment configured in an enlarged manner can, for example, be provided trapezoidally. The bases of the trapezoid are in this case oriented approximately radially and approximately parallel to one another (the angular offset on account of the different circumferential position is here ignored). The base that is arranged at the front in the direction of rotation is in this case longer than the base arranged at the rear. The radially outer leg here represents an arc section. The second leg then results from the connection of the ends of the bases that are arranged radially on the inside. In this design of the segments, it has also been found that the segments configured in a reduced manner are located in a kind of shadow of the segments configured in an enlarged manner. This results in even more favorable distribution of loading in terms of wear on the individual segments.

The present invention is explained in more detail below under reference to the drawings.

Figure 2:
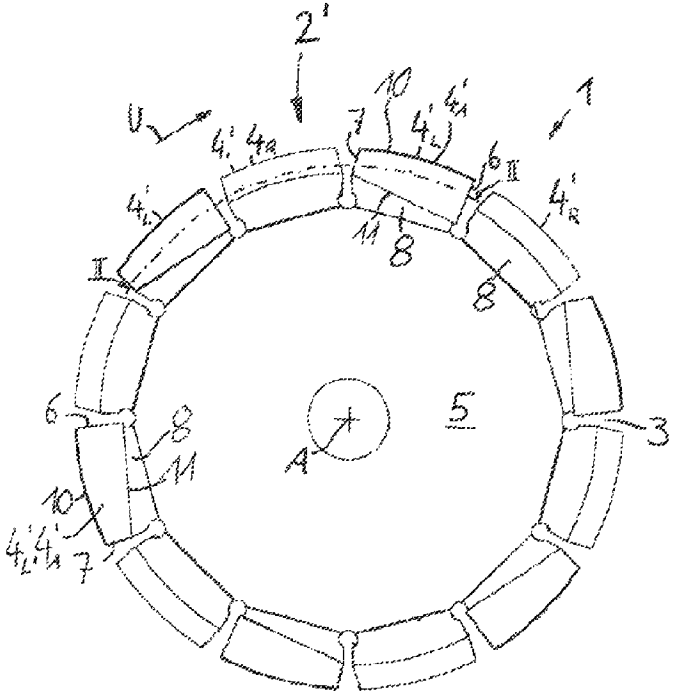
FIG. 2 shows a cutting tool according to the present invention in a front view.
Figure 1:
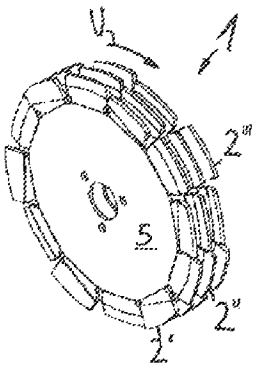
FIG. 1 shows a cutting tool according to the present invention in a side view.

FIGS. 1-3 show a cutting tool 1 according to the present invention, the cutting tool 1 comprises three cut-off wheels 2', 2", 2'''. The cut-off wheels 2' and 2''' are the axially outer cut-off wheels; the cut-off wheel 2" is the internal cut-off wheel. If, in an alternative embodiment, the cutting tool 1 only has two cut-off wheels, then both cut-off wheels are the axially outer cut-off wheels; provision is not then made for any internal cut-off wheels. Cutting tools 1 having more than three cut-off wheels comprise a plurality of internal cut-off wheels.

The first external cut-off wheel 2' has two different types of cutting segments, namely cutting segments $\mathbf{4}_L'$ that protrude toward the left and cutting segments $\mathbf{4}_R'$ that protrude toward the right. Both types of cutting segments protrude out of the cutting plane, since a respective carrier region 8, to which the segments 4 are fastened, is bent out compared with the blade body 5, which defines the central cutting plane E. The carrier region does not, however, need to be bent out, but can rather also be held on a common blade body 5 at an angle with respect to the cutting plane E' by some other measure; the cutting segments 4' must merely all project axially out of the central cutting plane E'. This also applies to the other cut-off wheels. The cutting segments that protrude toward the left and toward the right are arranged alternately in the circumferential direction.

On account of their axial protrusion outward out of the outermost central cutting plane E', the cutting segments $\mathbf{4}_L'$ that protrude toward the left at the same time also represent the axially external cutting segments of the entire cutting tool 1 and are also provided in the following text with the reference sign $\mathbf{4}_A'$ (index A representing outer). By contrast, the cutting segments $\mathbf{4}_R'$ of the first cut-off wheel 4' that protrudes toward the right represent internal cutting segments, which are also provided with the reference sign $\mathbf{4}_I'$ (index I representing inner). In an analogous manner to the cut-off wheel 2', the two other cut-off wheels 2" and 2''' also have cutting segments $\mathbf{4}_L''$, $\mathbf{4}_L'''$ and $\mathbf{4}_R''$, $\mathbf{4}_R'''$, respectively, which protrude either toward the left or toward the right out of the respectively central cutting planes E" and E'''. However, unlike in the case of the cut-off wheel 2', the cutting segments $\mathbf{4}_R'''$ that protrude toward the right represent the axially external cutting segments $\mathbf{4}_A'''$, present on the third cut-off wheel, of the cutting tool 1, these additionally also being designated by the reference sign $\mathbf{4}_A'''$. All of the cutting segments $\mathbf{4}_L''$, $\mathbf{4}_R''$ of the central cut-off wheel 2" are also all denoted internal cutting segments $\mathbf{4}_I''$, regardless of whether they protrude toward the left or toward the right, since they are not axially external cutting segments of the cutting tool 1.

The axially external cutting segments $\mathbf{4}_A'$ and $\mathbf{4}_A'''$ are the cutting segments of the cutting tool 1 that are subjected to the greatest load. They are configured in an enlarged manner compared with the other segments. As can be seen in particular from FIG. 2, these outermost cutting segments $\mathbf{4}_A'$ have a trapezoidally designed shape in a side view, this applying equally to the cutting segments $\mathbf{4}_A'''$ which cannot be seen. A front base 6 of this trapezoid in the direction of rotation U is longer than a rear base 7 of the trapezoid in the direction of rotation. The legs are formed not only by the circumferential boundary edge 10 of the cutting segment 4 but also by the separating line 11 between the carrier region 8 and segment 4, i.e. the connecting line of the other of the two internal ends of the front base 6 and the rear base 7. The internal segments $\mathbf{4}_I'$ are designed in a substantially annular manner with a constant radial dimension along the circumferential extent. The configuration of the internal segments $\mathbf{4}_I''$, $\mathbf{4}_I'''$ of the second and third cut-off wheels 2", 2'" corresponds to the configuration of the internal segments $\mathbf{4}_I''$, $\mathbf{4}_I'''$ of the first cut-off wheel 2'. The terms radial and parallel should be interpreted broadly in connection with the trapezoidal configuration and are intended to indicate the rough orientation. The terms can also include a slight curvature, i.e., not an exactly rectilinear configuration.

Figure 4:
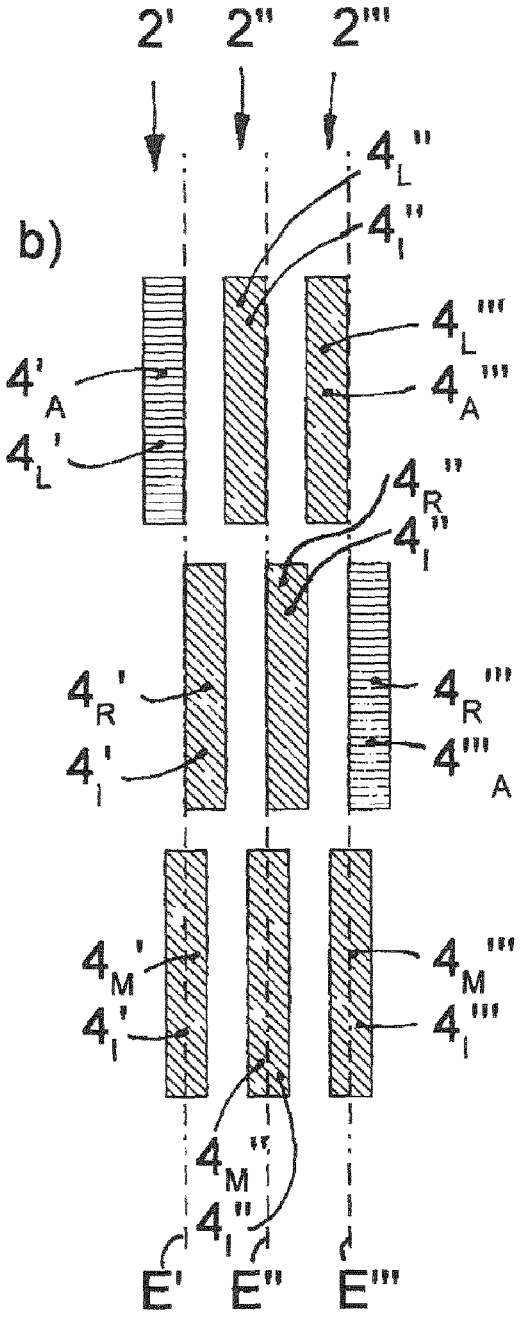
FIG. 4 shows a partial cross section through a number of cutting segments of an alternative cutting tool.

FIG. 4 shows an alternative embodiment, which corresponds largely to the embodiment according to FIGS. 1-3. For the sake of simplicity, only cross sections of three segments per cut-off wheel are shown, these being representative of all the other segments of the particular cutting tool. For further clarification, the cutting segments denoted internal and those denoted external are hatched differently. As a result, it is already visually clear that only a small number of the cutting segments are configured in a reinforced manner.

The illustration according to FIG. 4 corresponds basically to a section as is indicated in FIG. 2 by the connecting line II-II. In contrast to the embodiment according to FIG. 2, not only segments $\mathbf{4}_L$ and $\mathbf{4}_R$ that protrude toward the left and toward the right are present, but provision is also made of central cutting segments $\mathbf{4}_M'$, $\mathbf{4}_M''$, $\mathbf{4}_M'''$ which are not arranged in an offset manner with respect to the respective central cutting plane E. Such cutting segments are also designated internal cutting segments $\mathbf{4}_I$. The configuration of the central cutting segments $\mathbf{4}_M'$, $\mathbf{4}_M''$, $\mathbf{4}_M'''$ is identical to the rest of the internal cutting segments $\mathbf{4}_1$ already described. The measures that contribute to reinforcing the entire cutting tool consequently require only an enlarged configuration of a fairly small number of segments and can therefore be taken much more cost-effectively than the wholesale reinforcement of all of the cut-off wheels or all of the segments of all of the cut-off wheels.

Alternatively or in combination, one segment $\mathbf{4}_A$ can also be configured in a reinforced manner compared with another segment $\mathbf{4}_I$ in that the segments have a thicker cross section.

The present invention is not limited to embodiments described herein; reference should be had to the appended claims.

LIST OF REFERENCE NUMERALS

1 Cutting tool
2 Cut-off wheel
3 Segment gap
4 Cutting segment
5 Blade body
6 Front base
7 Rear base
8 Carrier region
10 Circumferential boundary edge/Leg
11 Separating line/Leg
E Central cutting plane
U Direction of rotation
A Rotation axis

What is claimed is:

1. A cutting tool comprising a plurality of cut-off wheels, the plurality of cut-off wheels being arranged alongside one another coaxially along a common rotation axis, each of the plurality of cut off wheels comprising a blade body which comprises a plurality of cutting segments distributed around a circumference of the blade body, each blade body defining a central cutting plane, some of the plurality of cutting segments being configured to protrude axially out of the central cutting plane, the plurality of cutting segments being arranged so that a segment gap exists between two cutting segments arranged adjacent to one another in a direction of rotation, and at least a first of the plurality of cutting segments arranged in a first axial position is configured to be larger than a second of the plurality of cutting segments arranged in a second axial position which differs from the first axial position.

2. The cutting tool as recited in claim 1, wherein each of the plurality of cut-off wheels is a diamond cut-off wheel.

3. The cutting tool as recited in claim 1, wherein all of the first of the plurality of cutting segments are configured to be identically larger than the second of the plurality of cutting segments.

4. The cutting tool as recited in claim 1, wherein the first of the plurality of cutting segments and the second of the plurality of cutting segments are each arranged in an axially opposite external position on the cutting tool.

5. The cutting tool as recited in claim 4, wherein the first of the plurality of cutting segments are configured as a trapezoid comprising a front base and a rear base in a side view, the front base and the rear base being oriented radially, the front base being arranged at a front in the direction of rotation being longer than the rear base being arranged at the rear in the direction of rotation.

* * * * *